United States Patent [19]

Fresch

[11] 4,364,729

[45] Dec. 21, 1982

[54] LADLE HEATING SYSTEM WITH AIR SEAL AND HEAT SHIELD

[75] Inventor: Haase D. Fresch, Lilburn, Ga.

[73] Assignee: The Cadre Corporation, Atlanta, Ga.

[21] Appl. No.: 168,260

[22] Filed: Jul. 10, 1980

[51] Int. Cl.[3] ..... F27D 3/00

[52] U.S. Cl. ..... 432/9; 266/44; 266/141; 432/10; 432/225

[58] Field of Search ..... 432/9, 10, 224, 225; 266/44, 141, 281, 901; 75/46; 110/173 A

[56] References Cited

U.S. PATENT DOCUMENTS

| | | | |
|---|---|---|---|
| 713,288 | 11/1902 | Cummings | 432/65 |
| 792,642 | 6/1905 | Williams | 266/141 |
| 1,057,905 | 4/1913 | Widekind . | |
| 1,675,735 | 7/1928 | Stohr . | |
| 2,294,168 | 8/1942 | Francis et al. | 432/224 |
| 3,148,272 | 9/1964 | Aitken et al. . | |
| 3,890,090 | 6/1975 | Sanderson | 110/173 A |
| 3,970,444 | 7/1976 | Brotzmann et al. | 75/46 |
| 4,001,996 | 1/1977 | Byrd, Jr. | 52/509 |
| 4,014,532 | 3/1977 | Holley | 266/287 |
| 4,106,755 | 8/1978 | Dell | 266/44 |
| 4,190,235 | 2/1980 | Dell | 266/44 |
| 4,223,873 | 9/1980 | Battles | 266/44 |
| 4,229,211 | 10/1980 | Battles | 75/46 |

FOREIGN PATENT DOCUMENTS

| | | |
|---|---|---|
| 463090 | 7/1928 | Fed. Rep. of Germany . |
| 464328 | 8/1928 | Fed. Rep. of Germany . |
| 2623545 | 12/1977 | Fed. Rep. of Germany . |
| 2377595 | 11/1978 | France . |
| 375924 | 5/1975 | Sweden . |
| 408276 | 6/1979 | Sweden . |
| 408277 | 6/1979 | Sweden . |
| 976426 | 11/1964 | United Kingdom . |
| 2005393 | 10/1978 | United Kingdom . |
| 2007342 | 10/1978 | United Kingdom . |

OTHER PUBLICATIONS

Stal-Laval Apparat AB Advertisement-10 pages.
Hotwork Advertisements-5 pages.

*Primary Examiner*—John J. Camby
*Attorney, Agent, or Firm*—Jones, Thomas & Askew

[57] ABSTRACT

A ladle for receiving molten metal is heated by a direct flame, by applying a lid to the rim of the ladle and directing an air stream through a heat exchanger and through the lid to the ladle, mixing fuel with the air and igniting the mixture and directing the flame into the ladle chamber, and exhausting the gases of combustion from the ladle chamber back through the lid and heat exchanger. A heat shield is mounted adjacent the lid and is sized and shaped to telescopically receive the rim of the ladle, and a ring of air is moved between the heat shield and the rim of the ladle to an air pickup ring. The ring of air blocks the gases escaping from inside the ladle through any openings between the ladle rim and the lid, the heat shield blocks heat radiation from any such openings, and the ring of moving air cools the heat shield. The air is moved from the pickup ring on through the heat exchanger where it is further heated, and then mixed with fuel for burning in the ladle to the air stream as the air stream moves toward the ladle chamber.

23 Claims, 6 Drawing Figures

LADLE HEATING SYSTEM WITH AIR SEAL AND HEAT SHIELD

TECHNICAL FIELD

This invention relates to a ladle heating system wherein a flame is directed into the chamber of a ladle and the hot gases are exhausted from the ladle through a heat exchanger which heats the oncoming combustion air that forms the flame, and specifically relates to an air seal applied to the rim of the ladle and a heat shield which extends about the rim of the ladle.

BACKGROUND OF THE INVENTION

In the ferrous and nonferrous molten metals industries, ladles and similar molten metal receivers such as torpedoes and tundishes, receive a charge of molten metal and the metal is later transferred to another vessel, such as to metal casting equipment, where it is cooled and solidified. The receivers for molten metal usually are lined with a refractory material, and it is desirable to preheat a receiver before molten metal is received in the receiver in order to avoid interface solidification of the metal upon contact between the metal and the cold interior surface of the receiver, and also to avoid thermal shock to the refractory liner of the receiver, thus avoiding deterioration of the liner. A preheated ladle also minimizes the heat loss from the molten metal as the metal is transported in the ladle from the furnace to the pouring position, thereby assisting in maintaining the molten metal at a high enough temperature for use in a casting machine or mold.

A common prior art method for heating ladles and other molten metal receivers prior to charging them with molten metal is to direct an open natural gas flame into the open chamber of the ladle. The open flame heating method permits combustion gases from within the ladle chamber to escape to the surrounding atmosphere. This permits a substantial amount of the heat energy to escape without effective use thereof, thus wasting an excessive amount of gas. Moreover, it is difficult to uniformly heat a ladle with an open flame, in that the ladle may be overheated in some areas and not heated sufficiently in other areas. Additionally, after a ladle has been initially heated, it is sometimes desirable to maintain the ladle in its heated condition if the ladle achieves its desired temperature before it is time to introduce the molten metal to the ladle. In this situation the open flame heating procedure continues to waste energy and hot spots are more likely to be formed in the ladle.

Recently, an improved ladle heating system was developed wherein a refractory fiber seal is mounted on a lid and the lid and seal are applied to the rim of a ladle and the open flame was applied through the lid to the ladle chamber. A heat exchanger is used to transfer some of the heat of the exhaust gases to the oncoming air used to support combustion. The fiber seal mounted on the lid is compressible and tends to conform to irregularities in the shape of the rim of the ladle as might be present from a build-up of slag or from chips and cracks in the rim. The structures of this type are disclosed in U.S. Pat. Nos. 4,223,873 and 4,229,211. The invention disclosed herein represents an improvement over recently developed heating systems.

SUMMARY OF THE INVENTION

Briefly described, the present invention comprises an improved system for preheating ladles and similar molten metal receivers wherein an open flame is directed into the ladle. A seal is mounted to a lid structure and the lid and seal are applied to the rim of the ladle, and the combustion air and fuel pass through the lid into the ladle and the combustion gases are moved back through the lid and through a heat exchanger to preheat the oncoming combustion air. A heat shield extends about the rim of the ladle, and an air barrier is directed from between the heat shield and rim of the ladle to the inlet of a blower and the air is moved from the blower either through a recycle path back to the air barrier or on through the heat exchanger and through the lid and in the ladle chamber.

The seal applied against the ladle rim is compressible and comprises for example, a network of refractory fiber modules each formed from a web of refractory fibers, with the webs formed in an accordion fold, and the modules are arranged in a common plane with the folds of each module arranged at a right angle with respect to the folds of the adjacent modules. The refractory fiber modules are maintained in compression by the lid support frame, and when the seal is pressed into abutment with the rim of the ladle, the modules that directly engage the rim tend to conform to the shape of the ladle rim and form a seal about the rim. The ability of the seal to be compressed tends to compensate for irregularities of the ladle rim as are usually caused by a build-up of slag or by chips or rough surfaces present on the ladle rim. However, in some instances where the seal is not precisely applied to the rim or where the build-up of slag on the rim or other rim or seal irregularities are present, combustion gases and/or radiant heat might escape from the ladle.

The heat shield includes an air pick-up ring or channel formed about the area of the seal to which the ladle rim is to be applied, and a plurality of air nozzles are arranged to direct air inwardly toward the channel. The rim of the ladle is received in telescoped relationship within the channel and the air nozzles form a circular air barrier about the rim of the ladle. The channel communicates with the inlet of the blower of the ladle heating system so that the heat from about the rim of the ladle is carried with the air to the ladle chamber. Thus, heat loss between the ladle rim and the seal, as by heat radiation or convection through a gap between the seal and rim, or by escaping gasses of combustion through a gap, are shielded from directly escaping to the atmosphere about the ladle, and the circular air barrier formed about the ladle rim tends to prevent the heat from escaping from the ladle and tends to carry the heat that does escape from the rim of the ladle back to the air flow system to be recycled through the ladle chamber.

Thus, it is an object of this invention to provide a heating system which efficiently heats ladles and other chambers with a flame in a controlled environment.

Another object of this invention is to provide an air barrier about the rim of a ladle which is being heated to a temperature suitable for receiving molten metal, wherein the heat in the ladle is substantially prevented from escaping from between the rim of the ladle nd the lid applied to the rim of the ladle.

Another object of this invention is to provide a heating system with an improved seal assembly which is effective to form a seal about the rims of ladles and other hot vessels and which compensates for the build up of slag on the rim of the ladle and for chips, cracks and other imperfections present in the rim of the ladle and retards the dissemination of heat and noise from between the ladle rim and the seal assembly.

Another object of this invention is to provide a ladle heating system that is inexpensive to construct and to operate, which conserves energy and which is durable and easy to repair.

Other objects, features and advantages of the present invention will become apparent upon reading the following specification, when taken in conjunction with the accompanying drawings.

DETAILED DESCRIPTION

Figure 1:
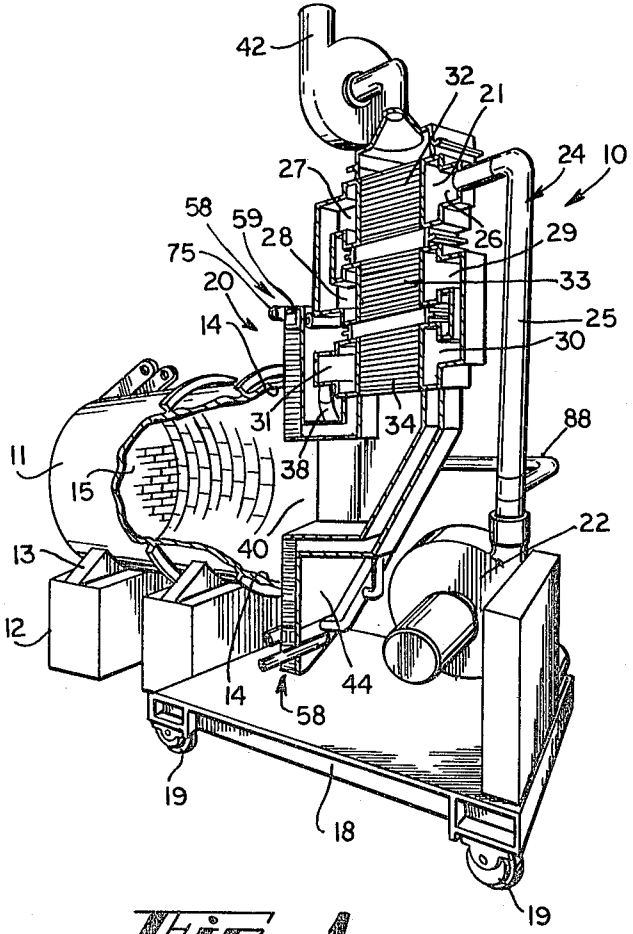
FIG. 1 is a perspective illustration of a ladle and the ladle heater, with portions removed to illustrate the inside of the ladle and the ladle heater.

Referring now in more detail to the drawings, in which like numerals indicate like parts throughout the several views, FIG. 1 illustrates the ladle heater 10 for heating ladles and other hot vessels such as ladle 11. The ladle 11 is illustrated as resting on its side on support blocks 12 and shims 13, with its rim 14 facing to the side. The ladle 11 includes a chamber 15 lined with fire brick or other suitable heat resistant material. The rim 14 typically is circular in shape but can include a pouring spout or other non-circular shapes. In some instances, a build-up of slag is present on the rim 14 of the ladle, or the ladle rim may be chipped or cracked or otherwise imperfect in shape.

Ladle heater 10 includes a carriage 18 mounted on wheels 19, and the wheels are movable along conventional tracks toward and away from the position of ladle 11 on support blocks 12. Lid or seal assembly 20, heat exchanger 21 and blower 22 are all mounted on carriage 18, and air conduit means 24 includes blower exhaust duct 25 which extends upwardly from the exhaust of blower 22, and a series of heat exchanger headers 26, 27, 28, 29, 30 and 31 mounted in series on opposite sides of the sets of heat exchange tubes 32, 33 and 34. The last heat exchanger header 31 communicates with burners 35 and 36 (FIG. 2) which direct a flame into the chamber 15 of the ladle 11. Branch conduits such as a branch conduit 38 extends from the last heat exchange header 31 to the burners 35 and 36. The burners extend through seal assembly 20 so as to communicate directly with the ladle chamber 15.

Exhaust opening 40 is formed through lid assembly 20 and exhaust conduit means 41 extends from opening 40 of lid assembly 20 between burners 35 and 36, first in a horizontal direction away from the the position of the ladle 11, then upwardly in series through the sets of heat exchange tubes 34, 33 and 32, then to exhaust blower 42. The exhaust duct work of the exhaust conduit means is heat insulated, and the heat exchange tubes 34, 33, and 32 are located out of the path of direct radiation from the open flame to be formed within the ladle chamber 15.

With the foregoing structure, a stream of air is generated from blower 22 through the air conduit means 24, caarrying the air in sequence through the series and heat exchange tubes 32, 33 and 34, then to the burners 35 and 36, and through the lid assembly 20 into the ladle chamber 15. The burners 35 and 36 are arranged to inject fuel into the air and to ignite the fuel and air mixture to that a flame is formed in the ladle chamber 15 which directly heats the ladle. The flames from burners 35 and 36 are directed toward the bottom wall surface of ladle 11, and tend to wash the inner surfaces of the ladle chamber with heat. Exhaust opening 40 tends to direct the gases of combustion back through the heat exchangers 34, 33 and 32. Exhaust blower 42 tends to balance the pressure within ladle chamber 15, thereby reducing the likelihood of leakage of the gases of combustion from ladle chamber 15.

Lid assembly 20 comprises upright support plate 44 which is supported from carriage 18 by a conventional supporting framework (not shown). The peripheral portion of upright support plate 44 can be formed in various geometrical shapes, such as circular, square or octagonal. In the embodiment illustrated, the lid assembly is formed in an octagonal shape, flange 45 extends about the peripheral edge of the support plate 44. Support flange 45 includes a plurality of rectilinear support segments 46, 47, 48, 49, 50, 51, 52 and 53. A network of refractory fiber modules or insulating blocks 54 are mounted in support frame 45, forming a surface of refractory fibers inside the frame elements. The refractory fiber modules 55 that are adjacent frame support segments 46-53 are held in place by the frame support segments, and each module 55 is attached at its rear surface to the upright support plate 44. A detailed description of similar insulating blocks is found in U.S. Pat. No. 4,001,996, and a system for mounting the insulating modules on a support plate is illustrated in U.S. Pat. No. 4,229,211.

In summary, each module or batt 55 is formed from a web or blanket of refractory fibers and the webs are in the form of elongated sheets. The sheets are folded in a zig-zag or an accordion arrangement so as to include a series of layers with exposed side edges and folds on a front surface and similar folds on the back surface of the modules. The modules are rectangular in shape and are each maintained in their accordion folded configuration by bands wrapped around each module until the modules are mounted to the upright support plate 44. The bands tend to hold the modules in compression until the bands are removed. The modules are packed within the confines of the support frame, and after they have been properly positioned and packed in the support frame their straps (not shown) are removed and the modules tend to expand out into compressive engagement with one another and therefore remain in compression due to their abutment with one another. It wll be noted that the folds of each module are oriented at a right angle with respect to the folds of the next adjacent modules. Thus, a parquet or alternating fold effect is created across the network of the seal assembly.

When the ladle heater 10 and ladle are moved into engagement with each other as shown in FIG. 1, the rim 14 of the ladle abuts the lid assembly 20. Since the lid assembly 20 includes the network of refractory fiber modules 55, each of which is formed in an accordion arrangement, the rim tends to penetrate or move into the surface of the seal assembly formed by the folds of the refractory fiber webs. As the rim is forced against the modules 55, and indentation is made in the refractory fibers. The rim and lid assembly are moved together with a force which is usually in excess of two pounds per square inch, preferably with a force between four and ten pounds per square inch, so that the rim tends to penetrate the surface of the seal assembly and a good seal is made about the ladle rim. The desired depth of indentation in the seal assembly is about three inches. The density of the refractory fiber modules is approximtely eight pounds per square inch. Thus, a firm seal can be made about the ladle rim 14 and a substantial thickness of the refractory fiber material remains between the ladle rim and the upright steel support plate 44 which supports the fiber modules 55.

Those modules 55 that are not directly engaged by the rim of the ladle remain uncompressed by the rim and tend to retain all their heat resistant characteristics, thus closing off the ladle opening inside the rim of the ladle, so that the lid assembly functions as a lid or closure wall with respect to the chamber 15 of the ladle except for exhaust opening 40 and the openings through which the burners 35 and 36 and temperature probes and other elements project. By this arrangement the refractory fiber web material of the modules 55 shields the other components of the ladle heater from direct heat radiation from the flame inside the ladle.

Figure 2:
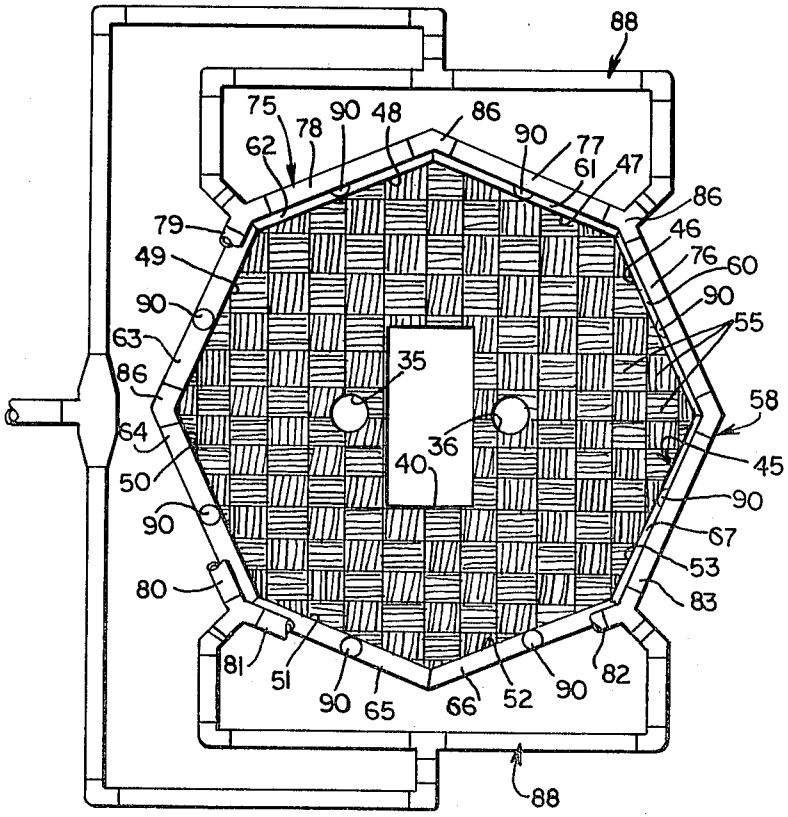
FIG. 2 is a front elevational view of the ladle lid assembly with the heat shield, with portions removed.
Figure 5:
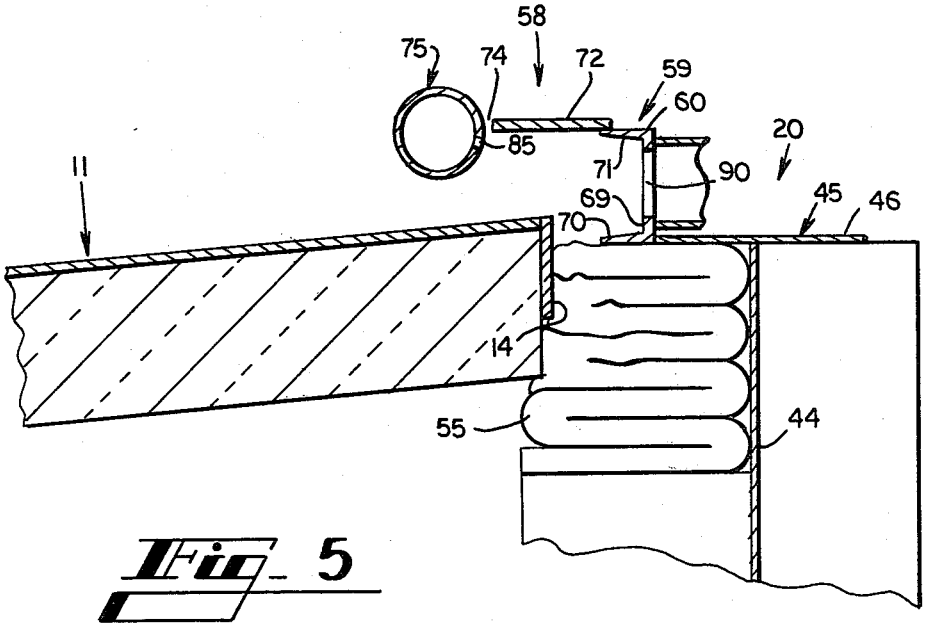
FIG. 5 is a detail illustration of an edge of the lid assembly and a portion of the heat shield.

As a ladle is used, a build up of slag usually occurs on the rim of the ladle and cracks and chips are formed in the rim. This causes the rim surface to be uneven, so that is more difficult to form a seal about the ladle rim. Eventually, leakage occurs between the ladle rim and the seal, whereby heat from within the ladle chamber 15 escapes due to radiation and/or convection. In order to mininize the escape of heat from the ladle at its point or seal with the lid assembly 20, heat shield 58 is formed about the seal assembly. Heat shield 58 comprises an air channel 59 mounted to the support flange 45 of the upright support plate 44. Air channel 59 is formed from a series of rectilinear channel segments 60, 61, 62, 63, 64, 65, 66 and 67 that are each mounted to a support segment 46-53 of the support flange 45 (FIGS. 2 and 5). Each channel segment 60-67 is mounted in end-to-end relationship with respect to the next adjacent channel segment, and each channel segment 60–67 is parallel to a corresponding support segment 46–53 of the support flange 45. Each channel segment 60–67 includes a bottom wall 69 and parallel side walls 70 and 71. Bottom wall 69 is substantially parallel to upright support plate 44, and the parallel side walls 70 and 71 project generally about the position to be assumed by the rim 14 of a ladle 11. A flange extension such as flange extension 72 is mounted to the outer leg 71 of each channel segment 60–67, with the outer edge 74 of each flange extension protruding beyond the plane of the seal surface formed by the modules 55. The flange extension 72 and the channel segments 60 therefore form an air channel 59 that extends from behind the seal surface formed by the modules 55 to a position beyond the seal surface.

In addition, air supply ring 75 is mounted coaxially with air channel 59. Air supply ring or bustle is also octagonal in shape and includes rectilinear segments 76, 77, 78, 79, 80, 81, 82 and 83. The rectilinear segments 76–83 are parallel to the support segments 46–53 and channel segments 60–67. The rectilinear segments 76–83 of the air supply ring are mounted in closely spaced relationship with respect to the outer edge 74 of each flange extension 72, so that the air supply ring functions as an additional extension of the flange extensions 72 of the air channel 59. A series of nozzle openings 85 are formed in the rectilinear segments of air supply ring 75, and each nozzle opening 85 is directed toward air channel 59. The segments of the air supply ring are mounted in angled joints such as joint 86, and the segments 77–83 can be rotated about their longitudinal axes so as to position the nozzle openings 85 at the desired location to provide a stream of air in a preferred direction.

Air supply ring 75 communicates with air supply conduit system 88, and air supply conduit system communicates with the blower exhaust duct 25 of blower 22. The air supply conduit system 88 is connected to alternate ones of the joints 86 of the air supply ring, so that a portion of the stream of air from the exhaust of blower 22 is directed to the air supply ring. In this way, a circular air curtain or air barrier is directed about the rim 14 of ladle 11 into the air channel 59.

Figure 3:
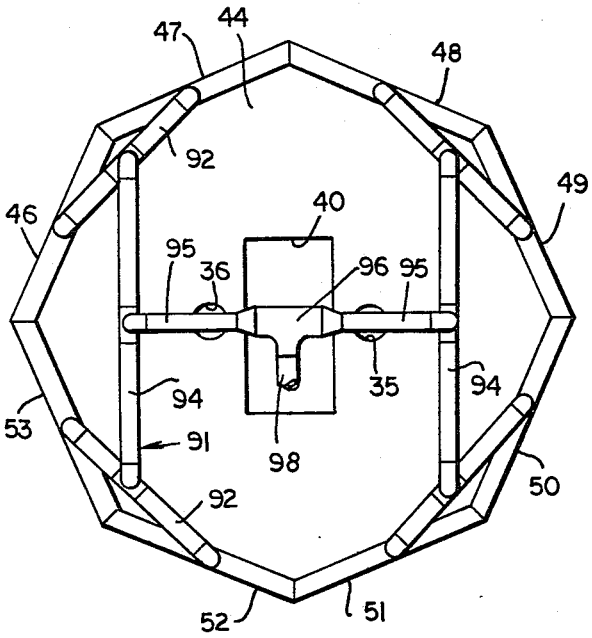
FIG. 3 is a back elevational view of the ladle lid assembly and heat shield.
Figure 4:
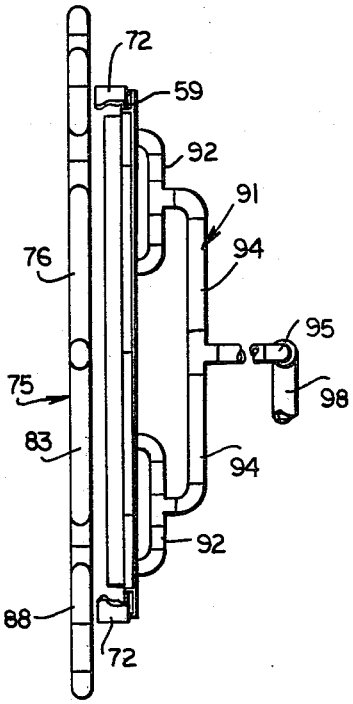
FIG. 4 is a side view of the ladle lid assembly with the heat shield.

An air opening 90 is formed through the bottom wall 69 of each channel segment 60–67 (FIG. 5) and air exhaust conduit system 91 communicates with each air opening 90. As illustrated in FIGS. 3 and 4, air exhaust conduit system 91 includes branch ducts 92 each connected at its ends to an air opening 90 of a air channel segment 60–67, intermediate ducts 94 each connected at its ends to the intermediate portion of a branch duct 92, and exhaust ducts 95 connected to the intermediate ducts 94 and to header 96, with header 96 being connected to air return conduit 98. Air return conduit 98 is connected to the suction side or inlet of blower 22. Thus, low pressure is created in air channel 59 about the rim 14 of ladle 11. This induces a curtain of air to flow about the rim of the ladle, between the ladle and the flange extension 72. Thus, the combined air curtains as induced by the air supply ring 75 and by the air channel 59 create a positive flow of air about the side wall of the ladle 11 adjacent its rim 14. In addition, any heat radiation emitted between the rim 14 of the ladle and the modules 55 is shielded by flage extension 72 since the ladle rim 14 is telescopically received through the air supply ring 75 and within the flange extension 72.

The air curtain passing between the ladle rim 14 and the heat shield 58 tends to carry the heat emitted by radiation and convection from the rim portion of the ladle to the inlet of blower 22, where the air is directed through the blower, through the heat exchangers 32–34, and to ladle 11. Any "stingers" or escaping flame from the rim of ladle 11 tend to be muffled by the heat shield 58, both in respect to sound as well as with respect to heat loss, and the heat emitted from the rim of the ladle is recycled through the ladle heater.

Figure 6:
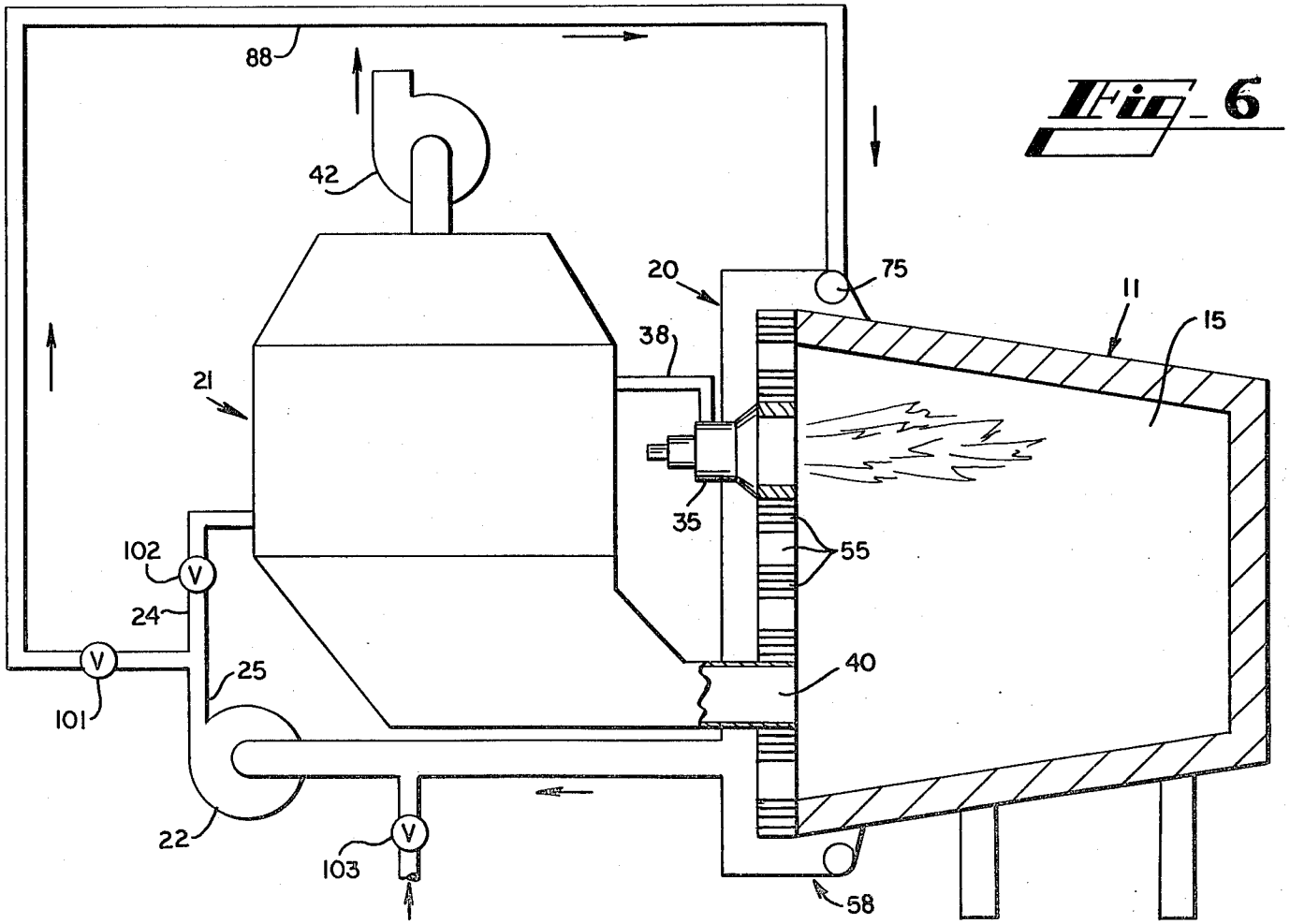
FIG. 6 is a schematic illustration of the ladle heater, showing the flow of gases through the heater.

As schematically illustrated in FIG. 6, air valve 101 controls the flow of air from the exhaust of blower 22 to the air supply ring 75, and air valve 102 controls the flow of air from the exhaust of the blower to the heat exchanger. A third air valve 103 controls the amount of make up air introduced to the system from the atmosphere. Therefore, air valves 101 and 103 can be adjusted to control the velocity of air moving in the air barrier about the rim of the ladle, and the pressure of the air at the rim. For example, if ambient air valve 103 is closed to reduce the amount of air taken in at this point in the system, more air must be pulled by the blower through the air curtain. This increases the velocity of the air curtain and reduces the pressure about the ladle rim. On the other hand, if valve 101 is opened wider this increases the velocity of the air curtain and increases the pressure about the ladle rim.

The air curtain effectively blocks the combustion gases from escaping through any openings formed between the ladle rim and the lid and seal applied to the rim, and the flange extension 72 and air supply ring 75 block radiant heat and noise which radiate through any such openings. The air of the air curtain collects heat from about the rim of the ladle and the air eventually becomes part of the combustion air which is used to heat the ladle. Thus, heat escaping from the rim of the ladle is recirculated to the ladle chamber.

While this invention has been described in sepcific detail with particular reference to a preferred embodiment thereof, it will be understood that variations and modifications can be affected within the spirit and scope of the invention as described hereinbefore and as defined in the appended claims.

I claim:

1. In an apparatus for heating a ladle or the like which includes a chamber with an opening and a rim about the opening, said apparatus comprising a lid assembly for engagement with the rim of the ladle, said lid assembly comprising a seal surface extending substantially in a single plane and extending to a greater breadth than the rim of the ladle for engaging the rim of the ladle, a heat exchanger mounted adjacent said lid assembly, air conduit means extending through said heat exchanger and through said lid assembly for directing air through the heat exchanger, through said lid assembly and into the ladle in engagement with the lid assembly, an exhaust gas conduit means extending through said lid assembly and through said heat exchanger for directing exhaust gases from the ladle in engagement with said lid assembly through said lid assembly and through said heat exchanger, blower means for inducing a stream of air through said air conduit means and a stream of exhaust gases through said exhaust gas conduit means, burner means for supplying fuel to said air conduit means and for directing a flame into the ladle in engagement with said lid assembly, the improvement therein of a heat shield mounted on said lid assembly including flange member extending from said lid assembly in a plane approximately perpendicular to the plane of said seal surface and shaped to telescopically receive therein the rim of a ladle, air conduit means communicating with said flange member and the inlet of said blower means whereby the heat shield blocks heat radiation from the periphery of the rim of a ladle abuting the seal surface and air is induced by the blower to flow from the atmosphere between the rim of the ladle and the flange member to the inlet of the blower means.

2. The apparatus of claim 1 and wherein said seal surface is formed from compressable refractory fiber modules, and further including means for urging said seal assembly and the rim of the ladle into compressive engagement with each other.

3. The apparatus of claim 1 and further including fluid supply conduit means in communication with the pressure outlet of said blower means and including means for directing a flow of fluid from said blower means between the rim of the ladle abuting the seal assembly and said flange.

4. The apparatus of claim 1 and further including a flange conduit mounted on and extending along said flange and spaced away from the plane of said seal surface and including nozzle means for directing a flow of fluid toward the space between said flange member and a rim of a ladle abuting the seal assembly.

5. The apparatus of claim 4 and wherein the pressure outlet of said blower means communicates with said flange conduit whereby fluid from said blower is directed toward the space between said flange member and the rim of a ladle abutting the seal assembly.

6. The apparatus of claim 1 and wherein said seal surface is formed by a plurality of refractory fiber modules each comprises a web of material with the web formed in a zig-zag arrangement with parallel overlying layers, with the layers of each module extending generally toward the position of the ladle so that the rim of the ladle can compress the layers along their lengths.

7. The apparatus of claim 6 and wherein said support frame includes an outer support flange surrounding said refractory fiber modules for supporting said fiber modules in compression against one another.

8. In apparatus for heating a ladle or the like which includes a chamber with an opening and a rim about the opening, said apparatus comprising a substantially flat seal surface means sized and shaped to engage the rim of the ladle, blower means for directing a flow of air through the seal surface into the ladle chamber and then back through the seal surface, means for heating the air directed to the ladle chamber, the improvement therein of a heat shield means extending about said seal surface, said heat shield means extending outwardly from the plane of the seal surface for receiving the rim of the ladle in telescoped relationship, and means for inducing a flow of air between the heat shield on one side and the portion of the seal surface in abutment with the rim of the ladle on the other side for mixing with the air flowing from the blower means through the seal surface and into the ladle chamber whereby air is directed from about the outer surface of the ladle adjacent the rim, is heated and is directed to the ladle chamber.

9. The apparatus of claim 8 and wherein said means for inducing a flow of air includes conduit means communicating with the inlet of said blower means and with said heat shield, whereby at least a portion of the air directed through the seal surface to the ladle chamber is preheated by the heat emitted at the rim of the ladle.

10. The apparatus of claim 8 and wherein said heat shield includes a flange member extending outwardly from the plane of the seal surface and conduit means positioned adjacent said flange member and spaced from the plane of the seal surface and including a series of nozzles arranged to direct a flow of air toward the space between said flange member and the rim of a ladle telescopically receive in said flange member.

11. In combination with apparatus for heating ladles or the like, a lid assembly for movement into abutment with the rim of the ladle, a heat shield mounted adjacent said lid assembly and sized and shaped to telescopically receive the rim of the ladle to be heated, and conduit means adapted to be arranged about the rim of the ladle for directing a flow of air at a position about the ladle between said heat shield and the area of said lid in engagement with the rim of the ladle, and blower means including an inlet means in communication with said conduit means and an exhaust means in communication through said lid assembly with the ladle.

12. The combination of claim 11 and wherein said apparatus includes a heat exchanger, said conduit means being constructed and arranged to direct a flow of air in sequence from said heat shield and through said blower means, through said heat exchanger, to the ladle, and back through said heat exchanger.

13. The combination of claim 11 and wherein said lid assembly includes a support frame and a layer of compressible refractory fiber material supported by said support frame and arranged in a configuration to engage the rim of the ladle and form a seal about the rim of the ladle.

14. In combination with apparatus for heating ladles or the like, a lid assembly comprising a support frame, a network of refractory fiber modules supported by said support frame in a common plane, each of said modules being held by the others of the modules and by said support frame in compression across the common plane, and a heat shield mounted adjacent said fiber modules and sized and shaped to telescopically receive the rim of the ladle to be heated, and means for directing a flow of air between said heat shield and the modules in engagement with the rim of the ladle.

15. A method of heating ladles and the like comprising moving the rim of the ladle to be heated and the substantially flat surface of a seal assembly into abutment with each other with the rim of the ladle received in telescoped relationship in a flange member mounted about the seal surface, inducing a flow of air in sequence between the flange member and the rim of the ladle in abutment with the lid assembly in a direction away from the rim of the ladle outside the ladle, through a heat exchanger, and through the lid assembly into the ladle, mixing fuel with the air and igniting the mixture as the mixture passes through the lid assembly and into the ladle, and exhausting the gases from the ladle through the lid assembly and through the heat exchanger.

16. A method of heating ladles and the like comprising applying a lid to the rim of the ladle to substantially close the ladle, directing a flow of air about the external surface of the ladle at the rim of the ladle to collect heat emitted from the ladle at the rim of the ladle in the air, collecting the air directed about the rim of the ladle and moving the collected air first through a burner and then through the lid to the interior of the ladle, adding fuel to the air, burning the air and fuel in the ladle, and exhausting the combustion gases from the ladle through the lid.

17. The method of claim 16 and further including the step of moving the air through a heat exchanger as the air moves toward the ladle, and moving the combustion gases through the heat exchanger, and bypassing some of the air around the heat exchanger and lid back to the rim of the ladle.

18. The method of claim 16 and further including the step of blocking radiant heat emitted from between the rim of the lade and the lid with a flange member extended in telescoped relationship about the rim of the ladle, and wherein the step of moving air from about the rim of the ladle comprises moving air between the flange member and the rim of the ladle.

19. A method of heating ladles and the like comprising the steps of applying a lid to the rim of the ladle, moving combustion air through the lid into the ladle, mixing fuel with the combustion air, igniting the mixture, exhausting the combustion gases from the ladle through the lid, and transferring some of the heat emitted from between the ladle rim and the lid to the combustion air before the fuel and combustion air are ignited.

20. The method of claim 19 and further including the step of forming a circular air barrier about the rim of the ladle.

21. The method of claim 19 and wherein the step of transferring some of the heat emitted from between the ladle rim and the lid comprises forming a heat shield about the rim of the ladle and moving at least some of the combustion air between the rim of the ladle and the heat shield prior to moving the combustion air through the lid and into the ladle.

22. A method of heating ladles and the like comprising the steps of applying a lid to the rim of the ladle, introducing a mixture of combustion air and fuel to a burner, igniting the mixture in the burner and directing the flame through the lid to the interior of the ladle, burning the combustion air and fuel in the ladle, exhausting the gases of combustion through the lid, forming an air barrier about the rim of the ladle, directing air from the air barrier to the burner, and combining air from the air barrier with the combustion air before the combustion air is introduced to the burner.

23. The method of claim 22 and wherein the step of forming an air barrier about the rim of the ladle comprises the step of moving air in an annular array along the outside surface of the ladle and axially beyond the rim of the ladle, and adding the air from the air barrier to the combustion air before the combustion air is moved through the lid.

* * * * *